United States Patent [19]

Asano

[11] 4,121,547

[45] Oct. 24, 1978

[54] CLOSED LOOP AIR-FUEL RATIO CONTROL SYSTEM FOR USE WITH INTERNAL COMBUSTION ENGINE

[75] Inventor: Masaharu Asano, Yokohama, Japan

[73] Assignee: Nissan Motor Company, Limited, Japan

[21] Appl. No.: 635,701

[22] Filed: Nov. 26, 1975

[30] Foreign Application Priority Data

Nov. 29, 1974 [JP] Japan ..... 49-137545

[51] Int. Cl.[2] ..... F02B 3/10

[52] U.S. Cl. ..... 123/32 EA; 123/32 EE; 123/119 EC; 261/121 B

[58] Field of Search ..... 123/32 EA, 32 EE, 119 EC; 261/121 B

[56] References Cited

U.S. PATENT DOCUMENTS

| | | | |
|---|---|---|---|
| 3,612,009 | 10/1971 | Kamazuka et al. | 123/32 EA |
| 3,789,816 | 2/1974 | Taplin et al. | 123/32 EA |
| 3,822,678 | 7/1974 | Bassot et al. | 123/32 EA |
| 3,835,820 | 9/1974 | Fujisawa | 123/32 EA |
| 3,851,635 | 12/1974 | Martin et al. | 123/32 EA |
| 3,921,612 | 11/1975 | Aono | 123/119 EC |
| 3,935,845 | 2/1976 | Aono et al. | 123/32 EA |
| 3,938,479 | 2/1976 | Oberstadt | 123/32 EA |

FOREIGN PATENT DOCUMENTS

544,218 12/1973 Switzerland.

*Primary Examiner*—Martin P. Schwadron
*Assistant Examiner*—G. L. Walton

[57] ABSTRACT

In an electronic closed loop control system for controlling the air-fuel ratio of an air-fuel mixture fed to an internal combustion engine to an optimum, the frequency of a dither signal is discretely or continuously changed to change a repetition rate of a pulsating signal in order to prevent engine vibration discomfortable to a driver, the pulsating signal being applied to at least one electromagnetic valve provided for regulating the air-fuel ratio of the air-fuel mixture.

9 Claims, 7 Drawing Figures

CLOSED LOOP AIR-FUEL RATIO CONTROL SYSTEM FOR USE WITH INTERNAL COMBUSTION ENGINE

The present invention relates generally to an electronic closed loop control system for use with an internal combustion engine of a carburetor type, and particularly to the above-mentioned control system for changing a dither signal in order to prevent an engine vibration discomfortable to a driver.

Various systems have been proposed to control the air-fuel ratio of an air-fuel mixture to an internal combustion engine to an optimum in dependence of the mode of engine operation, one of which is to utilize the concept of an electronic closed loop control system on the basis of a sensed concentration of a component in exhaust gases of the engine. The system generally comprises: a sensor, such as an oxygen analyzer, for sensing the concentration of a component in exhaust gases from the engine, the sensor being deposited in an exhaust pipe in such a manner as to be exposed to the exhaust gases to generate an electrical signal representative of the air-fuel ratio within the exhaust pipe; a difference signal generator connected to the sensor for generating an electrical signal representative of the deviation of the sensed air-fuel ratio from a reference value representing a desired air-fuel ratio which lies within a narrow window of three-way catalytic converter where its conversion efficiency is at the maximum; control means, which is usually a proportional-integral controller, being connected to the difference signal generator for integrating the signal therefrom; a dither signal generator for generating a dither or sawtooth wave signal at a constant frequency; a pulse generator being connected to both the control means and the dither signal generator for generating a train of control pulses at the frequency of the dither signal with a duration variable with the magnitude of the signal from the control means; and at least one electromagnetic valve being usually provided in an air supply passage and/or a fuel supply passage for controlling the air-fuel ratio of the air-fuel mixture to the desired value in response to the control pulses.

In the above-mentioned conventional closed loop control system, the frequency of the dither signal is constant, so that the repetition rate of the pulsating signal from the pulse generator is also substantially constant. Due to the constant repetition rate of the control pulse engine vibration or roughness occurs when the engine revolution approaches a certain RPM.

It is therefore an object of the present invention to provide an improved electronic closed loop control system wherein frequency of a dither signal is discretely or continuously varied in response to an engine operating parameter in order to prevent engine vibration.

This and other objects, features and attendant advantages of this invention will be appreciated by the following detailed description, where like parts in each of the several figures are identified by the same reference characters, and wherein.

Figure 3A:
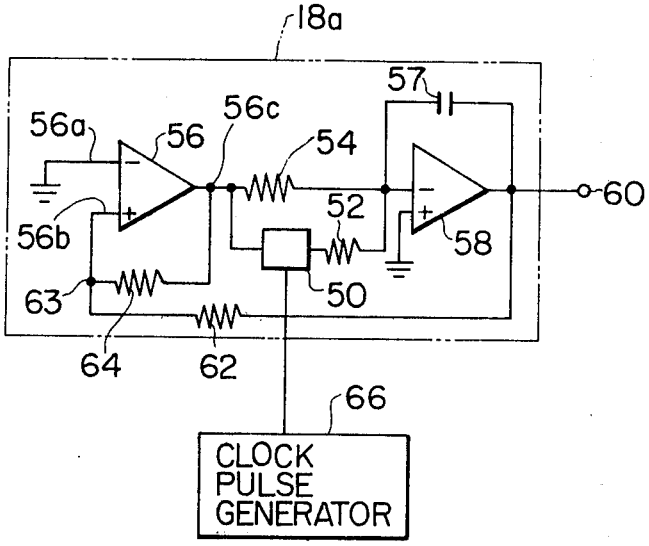
Figure 3B:
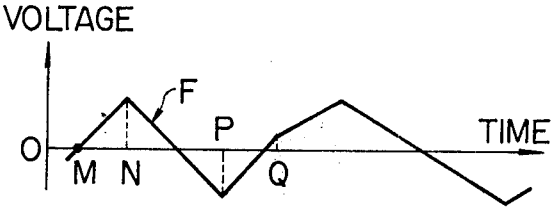
Figure 4:
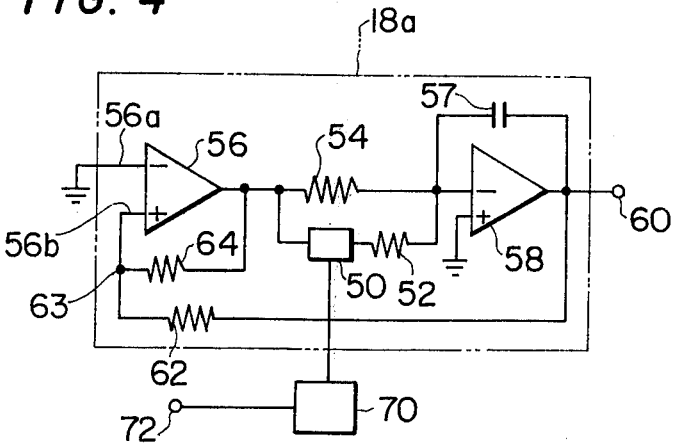
Figure 5A:
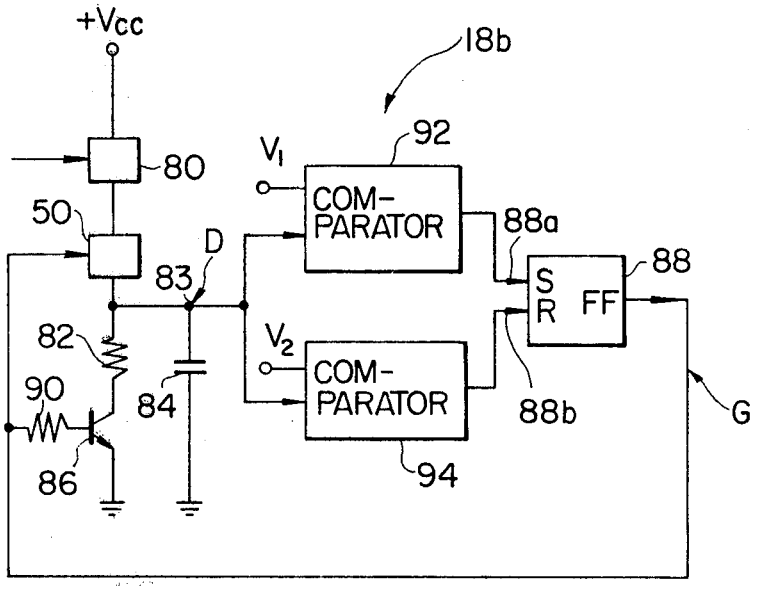
Figure 5B:
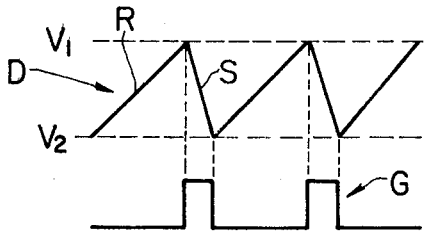

FIG. 3*a* illustrates a first preferred embodiment of the present inventon;

FIG. 3*b* shows a waveform useful for describing the operation of the FIG. 3*a* embodiment;

FIG. 4 illustrates a second preferred embodiment of the present invention;

FIG. 5*a* illustrates a third preferred embodiment of the present invention; and FIG. 5*b* shows two waveforms useful for describing the operation of the FIG. 5*a* embodiment.

Figure 1:
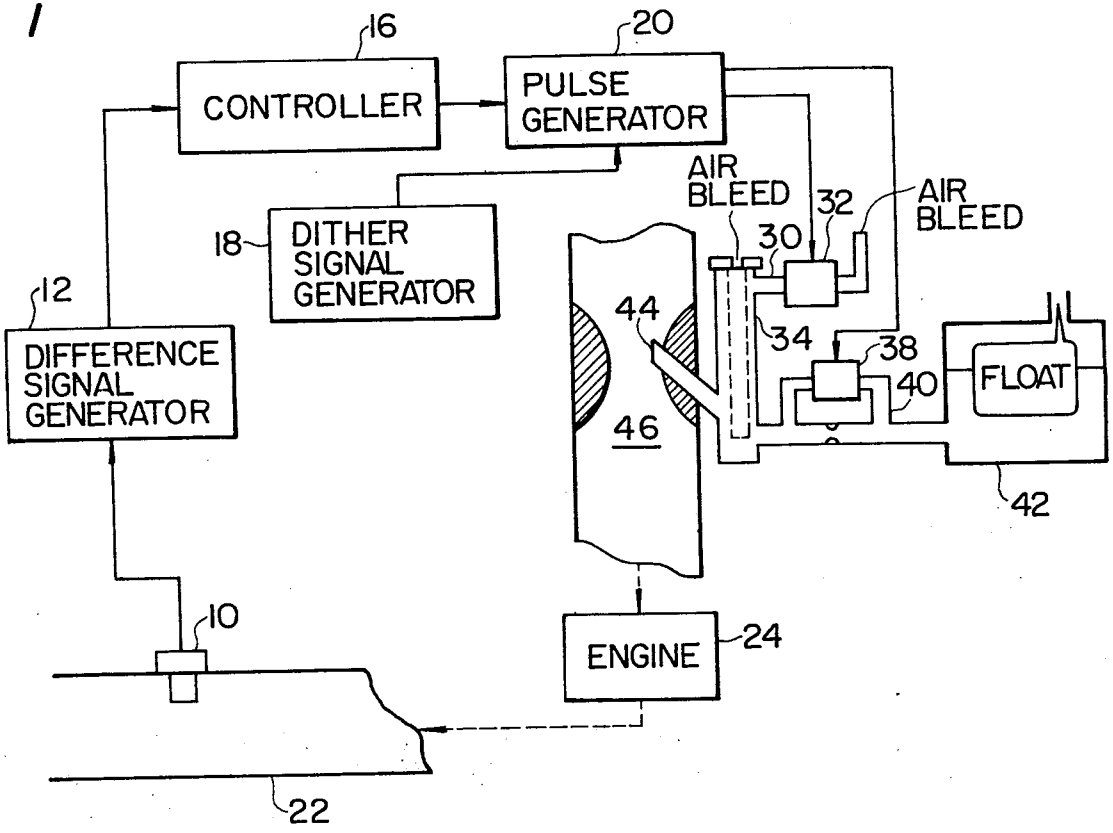
FIG. 1 illustrates a conventional electronic closed loop control system for regulating the air-fuel ratio of an air-fuel mixture.
Figure 2:
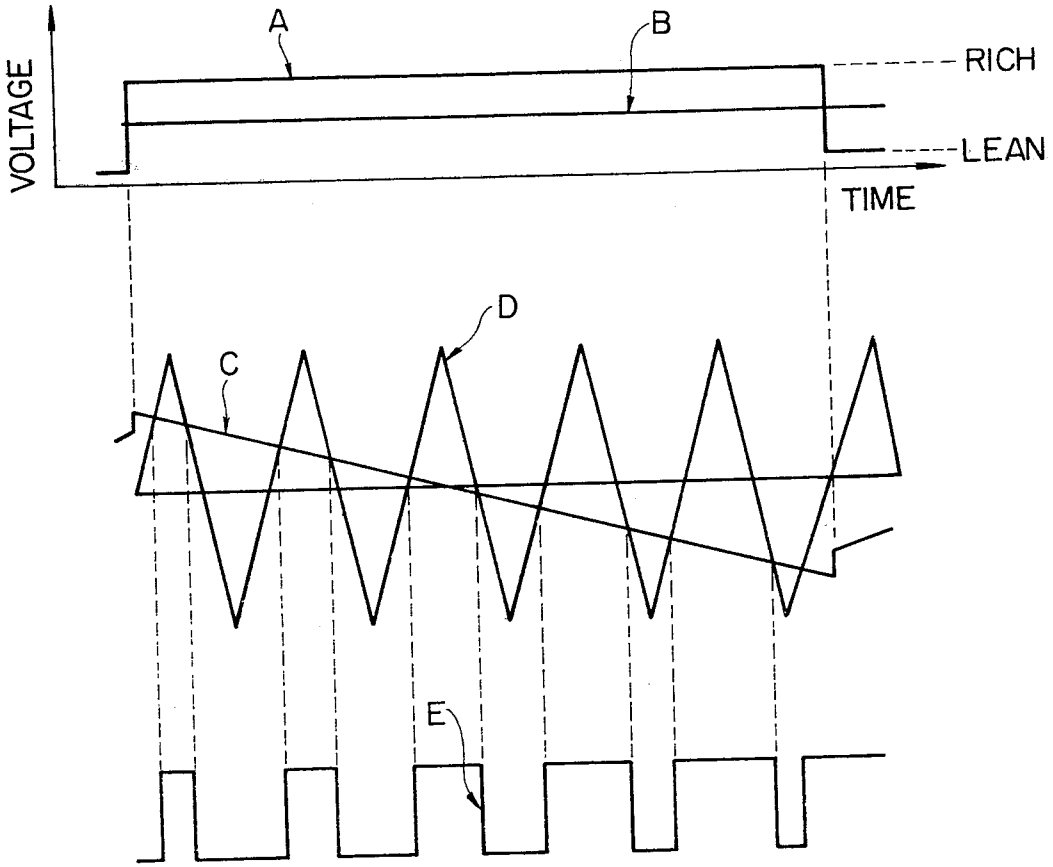
FIG. 2 shows several waveforms developed at or derived from several elements of the FIG. 1 system.

Reference is now made to FIGS. 1 and 2, wherein schematically illustrated are a conventional electrical closed loop control system for use with an internal combustion engine 24 of a carburetor type. A sensor 10, such as an oxygen analyzer, for sensing the concentration of oxygen in exhaust gases is disposed in an exhaust pipe 22 to generate an electrical signal representative of air-fuel ratio in the exhaust pipe 22, which signal is fed to a difference signal generator 12 which computes the derivation of the signal from the sensor from a reference level representing a desired air-fuel ratio within the catalytic converter window. A portion of the waveform of the signal from the sensor 10 is depicted by reference character A in FIG. 2. Reference B represents the desired air-fuel ratio. The signal from the difference signal generator 12 is then fed to control means 16 which usually includes a conventional p-i (proportional-integral) controller. The provision of the p-i controller, as is well known in the art, is to improve the efficiency of the electronic closed loop system, in other words, to facilitate a rapid transient response of the system. The output signal from the control means 16, which is depicted by reference character C in FIG. 2, is fed to the next stage, viz., a pulse generator 20 which can be considered as a pulse width converter and receives a dither or sawtooth wave signal (D in FIG. 2) from a dither signal generator 18 to generate a train of pulses E by comparing the amplitude of the sawtooth wave with the output from the control means 16. Each pulse of the signal E has a width which corresponds to the duration when the signal D is larger than the signal C as schematically shown in FIG. 2. The train of pulses of the signal E is then fed to two electromagnetic valves 32 and 38 in order to regulate the air-fuel mixture ratio. The valve 32 is provided in a supplementary air supply passage 30, which is connected at one end thereof to an air bleed chamber 34, for controlling the air flow rate, and on the other hand, the valve 38 is provided in a bypass fuel supply passage 40 for controlling fuel flow rate. The air-fuel mixture ratio is thus regulated and drawn into the engine 24 through a nozzle 44 projecting into a venturi 46.

In the preceding, the pulse generator 20 is exemplified as generating the single kind of signal E, however, the pulse generator 20 can be designed to generate two kinds of pulsating signal respectively applied to the two valves 32 and 38 to even more properly regulate the air-fuel mixture ratio.

In the conventional electronic closed loop control system illustrated in connection with FIGS. 1 and 2, the frequency of the dither signal D is maintained constant so that the repetition rate of the signal E is substantially constant. Owing to the substantially constant repetition rate of the signal E, there is encountered a drawback in the prior art as set forth below.

When the frequency of the dither signal approaches the engine revolution, the mixture ratio of a given engine cylinder tends to vary recyclically and oscillate at a frequency from 0.5 to 1 cycle per second. This results in engine roughness perceptible by the vehicle occupant.

The present invention is therefore directed to remove the undesirable engine vibration by discretely or continuously changing the frequency of the dither signal D (FIG. 2).

Reference is now made to FIGS. 3*a* and 3*b*, wherein illustrated is a first preferred embodiment of a dither signal generator 18*a* and a clock pulse generator 66 of the present invention together with two waveforms showing the function of the generator 18*a*. The arrangement of the dither signal generator 18*a* and the generator 66 is for discretely changing the dither signal D. To begin with, let it be supposed that (1) switching means 50 is in an open state so that a resistor 52 is electrically disconnected from resistor 54, and (2) a certain negative voltage initially develops at the output terminal 56*c* of an operational amplifier 56 and its noninverting input is biased negative with respect to its inverting input which is grounded.

An integral operational amplifier 58 provides integration of the output from amplifier 56 to develop a voltage F at the output terminal 60 which is fed back through resistor 62 to the noninverting input of amplifier 58 and thence through resistor 64 to the output of amplifier 58. The voltage F rises linearly at a rate determined by the time constant of resistor 54 and capacitor 57 from zero at time M so that the noninverting input of amplifier 56 is driven positive to offset its negative bias. The amplifier 56 is switched to the positive output state when the noninverting input rises above the ground potential. The direction of integration is changed in response to the change of polarity of output from amplifier 56 so that at time N the voltage at the output terminal 60 linearly decreases. The positive bias on the noninverting input of amplifier 56 then starts to decrease, and upon reaching the zero potential the amplifier 56 switches to the negative output state at time P. These process will be repeated until at time Q when the switching means 50 is assumed to be closed in response to a clock pulse from generator 66 to bring resistor 52 in parallel connection with resistor 54, resulting in a lowering of the integration rate as illustrated in FIG. 3*b*. The repetition frequency of triangular wave is reduced in response to the application of a clock pulse.

Reference is now made to FIG. 4, wherein illustrated is a second preferred embodiment of the dither signal generator 18*a* and an engine speed detector 70 of the present invention. The difference between the circuit arrangements of FIGS. 3*a* and 4 is that the clock pulse generator 66 is replaced by the engine speed detector 70. The detector 70 receives a signal representative of engine speed at its input terminal 72 to detect a predetermined or a particular engine speed (for example, 3,600 rpm) by, for example, comparing the incoming signal with a reference value. When detecting the predetermined engine speed, the detector 70 actuates the switching means 50 in order to connect the resistor 52 across or disconnect the same from the resistor 54 for the above-mentioned purpose.

It is understood that the second preferred embodiment ensures more accurate operation of avoiding the undesirable engine vibration as compared with the first.

It is apparent that, in the preceding two preferred embodiments, more than two modes of frequency variation are possible by providing a plurality of switching means 50 and their associated resistors, etc.

In FIGS. 5*a* and 5*b*, there is illustrated a third preferred embodiment of a dither signal generator 18*b* of the present invention. The third preferred embodiment is, unlike the preceding two preferred ones, intended to continuously change the frequency of the dither signal D. A current regulating circuit 80 of constant-current type is interposed between a positive power source (not shown) and the switching means 50. The current changing means 80 receives a signal representative of engine speed to change, in response to variation of engine speed, the amount of current flowing into a resistor 82, a capacitor 84, etc. through the switching means 50. A transistor 86 has the collector connected to the resistor 82 and the emitter connected to the ground. The base of the transistor 86 is connected to both the switching means 50 and the output of a flip-flop 88 through a resistor 90. The capacitor 84 is connected in parallel with a series circuit consisting of the resistor 82 and the transistor 86. The flip-flop 88 receives at its set terminal 88*a* an output signal from a comparator 92, and an output from a comparator 94 at its reset terminal 88*b*. The comparator 92 compares a voltage developed at a junction 83 (which voltage corresponds to the dither signal D in FIG. 5*b*) with a reference voltage $v_1$ to generate the signal therefrom when the former exceeds the latter. Whilst, the comparator 94 compares the voltage developed at the junction 83 with a reference signal voltage $v_2$ ($<v_1$) to generate the signal therefrom to reset the flip-flop 88 when the former falls below the latter. An output signal from the flip-flop 88 is depicted by reference character G in FIG. 5*b*, wherein a higher and a lower voltage of the signal G are respectively generated while the flip-flop 88 is in the set and the reset states.

In operation, initially assuming that the switching means 50 is closed and the transistor 86 is non-conductive, then the voltage D developed at the junction 83 gradually increases as indicated by reference character R (FIG. 5*b*) and exceeds it, reaches $v_1$ and exceeds it, the comparator 92 instantaneously generates its output signal therefrom which serves to set the flip-flop 88. The flip-flop 88 in turn generates its output signal G to open the switching means 50' and also to render the transistor 86 conductive, so that the voltage at the junction 83 starts to decrease as shown by reference character S in FIG. 5*b*. When the voltage at the junction 83 falls below $v_2$, the comparator 94 instantaneously generates its output signal therefrom which serves to reset the flip-flop 88. Following, the above-mentioned operation is repeated. The decreasing rate is previously determined by the electrical characteristics of the elements, viz., the resistor 82, the capacitor 84, and the transistor 86. It is therefore understood that the increasing rate of the slope R can be changed by varying the amount of the current that charges capacitor 84. For this reason, the current regulating circuit 80 receives the signal representative of engine speed to control the voltage across capacitor 84.

In the above, the difference signal generator 12 can be replaced by a suitable comparator. Furthermore, the resistors 52 and 54 can be replaced by a variable resistor, in the case of which the switching means 50 is substituted by a suitable rotating means such as, for example, a stepper motor.

It is apparent that various modifications may be made in the illustrated embodiments of the present invention within the intended scope of the invention as set forth in the hereinafter appended claims.

What is claimed is:

1. A closed loop fuel control system for a multi-cylinder internal combustion engine including an intake passage leading to the cylinders, air fuel supply conduit means for supplying air and fuel to said intake passage in variable ratio, and exhaust means, the system comprising:

an exhaust gas sensor provided in said exhaust means for generating a first signal representing the concentration of a composition of gases in said exhaust means;

means for generating a second signal representing the deviation of said first signal from a reference level indicating a desired air-fuel ratio;

a variable frequency oscillator for generating a third signal of which the frequency is variable in dependence upon the speed of said engine;

a pulse width converter responsive to said second and to said third signal for generating a train of pulses of which the duration is dependent upon the magnitude of said second signal and the frequency, is dependent upon the frequency of said third signal from said variable frequency oscillator; and electromechanical flow control means disposed in said air fuel supply conduit means and responsive to said train of pulses for controlling the air-fuel ratio to said desired value.

2. A closed loop fuel control system as claimed in claim 1, wherein said variable frequency oscillator comprises:

a capacitor for developing a voltage thereacross;

a first comparator for generating an output when the voltage across said capacitor is above a first reference level;

a second comparator for generating an output when said voltage is below a second reference level lower than said first reference level;

a bistable device operable to assume a first binary state in response to the output from said first comparator and a second binary state in response to the output from said second comparator; and means for charging said capacitor to develop said voltage representative of the speed of the engine in response to the first binary state of said bistable device and discharging the capacitor in response to the second binary state of said bistable device.

3. A closed loop fuel control system as claimed in claim 2, wherein said charging means includes means for causing the current that charges said capacitor linearly with time, whereby the rate of variation of the voltage across said capacitor is linearly proportional to the speed of the engine.

4. An electronic closed loop control system claimed in claim 1, wherein said oscillator is a dither signal generator which comprises:

an operational integrator including, a first operational amplifier which generates said dither signal from its output terminal, resistor means connected to an input terminal of said first operational amplifier, changing means for changing the resistance of said resistor means, and a capacitor connected across said first operational amplifier, said dither signal control means connected to said switching means for controlling the operation thereof in order to change the time constant of said operational integrator, thereby changing the frequency of said dither signal;

an operational comparator including a second operational amplifier which is connected through said resistor means to said input terminal of said first operational amplifier;

a voltage divider consisting of at least two resistors which are connected between the output terminals of said first and said second operational amplifier, a junction between said at least two resistors being connected to one of two input terminals of said second operational amplifier for applying a voltage developed at said junction to the same, said second operational amplifier alternatively generating a predetermined high and a predetermined low voltage in dependence of the voltage at said junction.

5. An electronic closed loop control system claimed in claim 4, wherein said resistor means is a variable resistor.

6. An electronic closed loop control system claimed in claim 4, wherein said resistor means includes a plurality of resistors connected in series to an input terminal of said first operational amplifier, said changing means connecting at least one of said plurality of resistors and disconnecting the same from the remaining resistors thereof.

7. An electronic closed loop control system claimed in claim 4, wherein said dither signal control means is a clock pulse generator.

8. An electronic closed loop control system claimed in claim 7, wherein said clock pulse generator is an astable multivibrator.

9. An electronic closed loop control system claimed in claim 7, wherein said second control means is an engine speed detector for detecting a predetermined engine speed to generate a signal therefrom, which predetermined engine speed causes the engine vibration discomfortable to the driver, said signal from said engine speed detector being applied to said changing means for actuating the same to change the frequency of said dither signal.

* * * * *